US006006375A

United States Patent [19]

Carr

[11] Patent Number: 6,006,375

[45] Date of Patent: Dec. 28, 1999

[54] REMOVABLE THRESHOLD

[75] Inventor: Jeffery N. Carr, Shippenville, Pa.

[73] Assignee: CFM, Inc., Shippenville, Pa.

[21] Appl. No.: 08/948,806

[22] Filed: Oct. 10, 1997

[51] Int. Cl.[6] ..... A47K 3/22

[52] U.S. Cl. ..... 4/613; 4/609; 52/34; 49/469; 49/471

[58] Field of Search ..... 4/604, 605, 609, 4/612–614, 607, 610; 52/34, 35; 49/467–471

[56] References Cited

U.S. PATENT DOCUMENTS

| | | | |
|---|---|---|---|
| 328,814 | 10/1885 | Roscoe | 49/467 |
| 344,963 | 7/1886 | Hayes | 49/467 |
| 2,049,061 | 7/1936 | Hoegger, Sr. | 4/609 |
| 2,129,381 | 9/1938 | Oftedal et al. | 49/471 |
| 2,757,385 | 8/1956 | Whittick . | |
| 2,849,763 | 9/1958 | Leigh | 49/469 |
| 3,096,526 | 7/1963 | Vecenie . | |
| 3,148,419 | 9/1964 | Straus et al. | 49/469 |
| 3,261,130 | 7/1966 | Lawson | 49/469 |
| 3,363,267 | 1/1968 | Kaiser . | |
| 3,457,568 | 7/1969 | Amatruda . | |
| 3,606,617 | 9/1971 | Frazier . | |
| 3,737,921 | 6/1973 | Baumrind | 4/609 |
| 3,744,065 | 7/1973 | Yavitch . | |
| 3,800,335 | 4/1974 | Buonaura . | |
| 4,423,528 | 1/1984 | Wiedmeier . | |
| 4,557,004 | 12/1985 | Piana . | |
| 5,092,002 | 3/1992 | Powers | 4/613 |
| 5,341,527 | 8/1994 | Schmidt . | |
| 5,437,303 | 8/1995 | Johnson . | |

FOREIGN PATENT DOCUMENTS

| | | | |
|---|---|---|---|
| 342702 | 11/1989 | European Pat. Off. | 4/612 |
| 3514489 | 10/1986 | Germany | 4/612 |
| 492 | of 1903 | United Kingdom | 49/467 |

*Primary Examiner*—Charles R. Eloshway
*Attorney, Agent, or Firm*—Frederick L. Tolhurst

[57] ABSTRACT

A removable threshold (18) wherein a first sidewall (20) and a second sidewall (22) are joined to a top section (48). The first sidewall (20) has a lower lateral edge (26) and terminal portions (28 and 30) that form radiused corners (68 and 70). The second sidewall (22) has a lower lateral edge (34) and terminal portions (36 and 38) that form radiused corners (76 and 78). Top section (48) has ends (54 and 56) that define radiused edges (84 and 86). Edges (84 and 86) are flush with the edges of terminal portions (28, 30, 36 and 38) and a gasket (62) is secured continuously to threshold (18) along lower lateral edges (26 and 34), terminal portions (28, 30, 36 and 38) and edges (84 and 86) to provide a seal between threshold (18) and a fixture (10).

16 Claims, 3 Drawing Sheets

REMOVABLE THRESHOLD

BACKGROUND OF THE INVENTION

1. Field of the Invention

The invention is directed to molded fixtures and, more particularly, molded fixtures that are adaptable for specific users such as physically disabled or aged users.

2. Description of the Prior Art

Various types and styles of sinks, showers and bathtubs and other bathroom fixtures have been developed over the years. Generally, such fixtures are formed of rigid materials such as cast iron, stainless steel, or fiber-reinforced plastic. Typically, these materials are shaped into a continuous, monolithic body such that they are rigid enough to support a given weight and remain watertight over many years of use. However, the same rigid, monolithic characteristics of such conventional fixtures also tend to make them difficult to modify to meet special applications such as occasional or episodic use by physically disabled or aged users.

More recently, a need for efficient, flexible usage of bathroom fixtures has been compounded by a need to meet certain legal requirements pertaining to physically disabled persons. This has increased the demand for shower stalls and other bathroom fixtures that can be easily modified to meet the varying needs of diverse users.

For example, conventional showers have a permanent curb or barrier that extends completely around the base of the shower. In this way, water from the shower nozzle is collected and retained in the shower pan until it is discharged through the drain. Examples of such conventional construction are shown in U.S. Pat. Nos. 2,757,385; 3,363,267; 3,606,617; 3,800,335; and 4,557,004. This construction has worked well in many applications. Ingress and egress to the shower is normally had merely by stepping over the curb. However, when the user is physically disabled, such as when requiring the use of a wheel chair, the curb operates as a barrier to the user.

In response to this difficulty, special shower designs have incorporated permanent ramps and various types of other structures instead of a conventional curb. In this way, wheelchair-bound users can easily gain access to the shower and the barrier for a physically disabled person is removed. Unfortunately, such ramps or other structures generally do not provide a water barrier that is as effective as the conventional curbs. Therefore, it would be preferred to make ramps and other access structures available, but only at times when those structures are useful in serving the needs of the individual user. At other times it would be preferable to have a more effective water barrier present.

Such adaptability of the shower structure is generally limited by the materials and design of the shower. As previously mentioned, showers are frequently constructed of a unitary or monolithic body of molded plastic or other material that provides a dense, continuous, waterproof surface for containing and channeling water. In some cases modular shower units such as disclosed in U.S. Pat. No. 4,423,528 have been developed. In these examples, the shower is comprised of an assemblage of components that fit together to form a body. However, such modular units generally require special measures to assure that the components fit together permanently in a watertight manner. Such modular units are not readily adaptable to meet the convenience or needs of particular users. In particular, such units have incorporated either the curb-style or ramp-style design and one design is not easily modified to the other.

Accordingly, there was a need in the prior art for a fixture that was readily convertible between the ramp-style design and the curb-style design. Such a convertible fixture would not only have immediate and significant advantages for the user, but would be advantageous in other respects as well. For example, where such convertible showers were installed in hotels or nursing homes, they would not only meet the individual needs of particular guests and patients, they would also tend to maximize use of the facility in conformance with applicable government standards, such as those pertaining to physical disabilities.

SUMMARY OF THE INVENTION

In accordance with the subject invention, a removable threshold for use in bathroom fixtures includes a top section that has two elongated sides. The threshold also includes first and second sidewalls, each with an upper boundary and a lower lateral edge. The upper boundary of each sidewall is joined to a respective elongated side of the top section. A gasket is connected to the lower lateral edge of at least one sidewall to provide a seal between the threshold and the fixture.

Preferably, the first and second sidewalls also have oppositely disposed ends, each end having an edge that joins the lower lateral edge of the sidewall in a radiused corner. The gasket is connected to the sidewall continuously along the lower lateral edge and along the edge of each end of the sidewall, including the radiused corners of the sidewall.

Also, preferably, the top section includes first and second end portions that are located between the elongated sides. The end portions of the top section form an edge that is continuous over the end portion and that is flush with the edge of the respective ends of the first and second sidewalls. The gasket is connected continuously to the sidewall and to the ends of the top section along the lower lateral edge of the sidewall, along the edge of each end of the sidewall, including the radiused corners thereof, and along the continuous edge of the first and second end portions.

Most preferably, the removable threshold is secured to the fixture by a fastener and anchor assembly wherein the anchor is secured to the fixture and wherein the fastener is threadably connected to the anchor. The fastener engages the anchor through a hole in at least one of the end portions of the top section and the ends of the first and second sidewalls to urge the threshold against the fixture.

Other objects and advantages of the subject invention will become apparent to those skilled in the art as a description of a preferred embodiment of the invention proceeds.

BRIEF DESCRIPTION OF THE DRAWINGS

A presently preferred embodiment of the invention described herein is shown and described in connection with the accompanying drawings wherein.

PREFERRED EMBODIMENT OF THE INVENTION

As shown in FIGS. 1–4, a fixture such as shower stall 10 has a drainage pan 12 and a passageway 14 for ingress and egress. In the area of passageway 14, drainage pan 12 is provided with a raised lip 16 that forms a general bevel shape at the base of passageway 14. Lip 16 has a sufficiently low elevation to allow passage of wheelchairs and other supportive devices through passageway 14. The precise structure of lip 16 is not crucial to the subject invention and other shapes such as ramps or other wheelchair-admissible structures could also be used.

Figure 1:
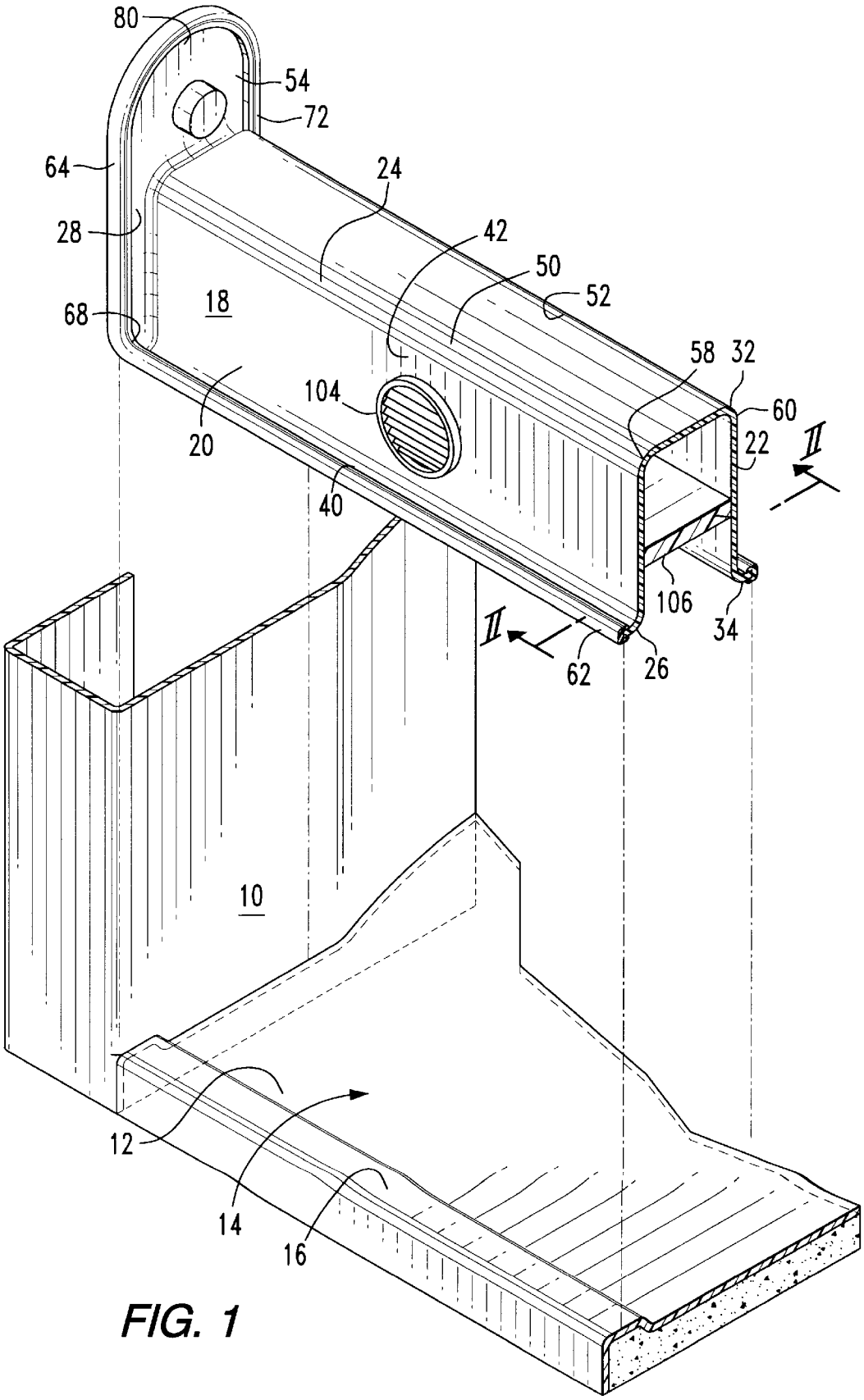
FIG. 1 is an exploded orthogonal view of the disclosed fixture and removable threshold.
Figure 2:
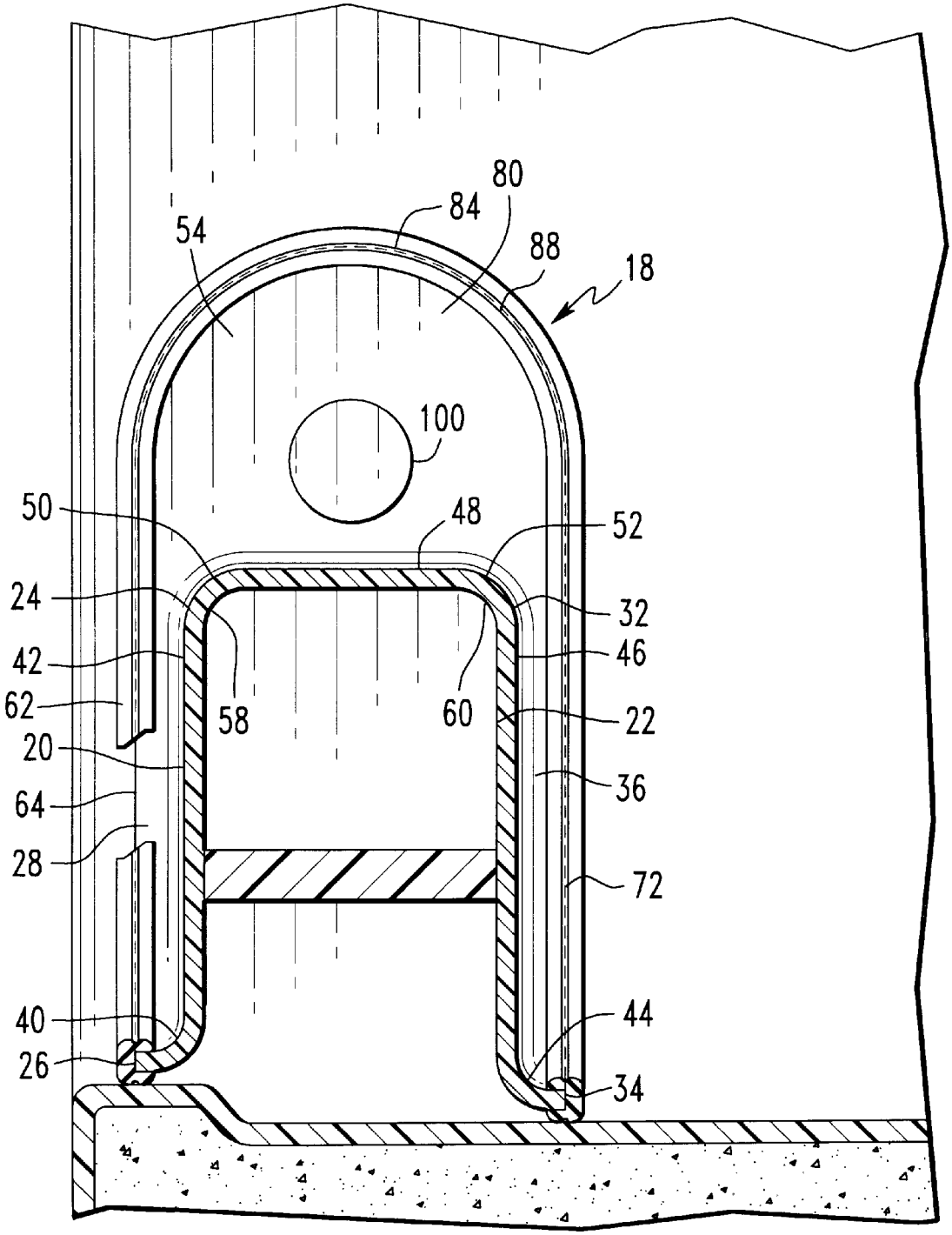
FIG. 2 is cross-section of the removable threshold shown in FIG. 1 taken along the lines II—II.
Figure 4:
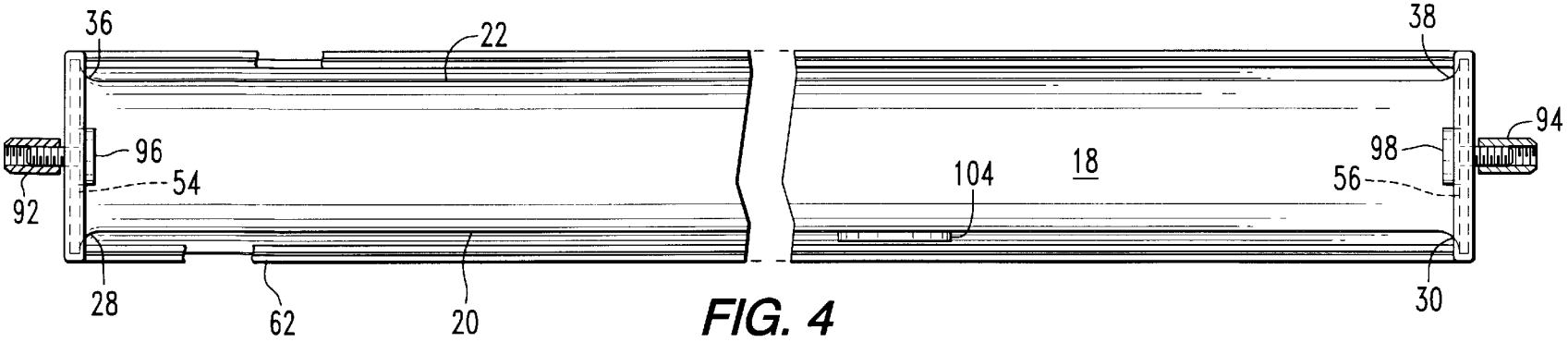
FIG. 4 is a broken plan view of the removable threshold shown in FIG. 3.
Figure 3:
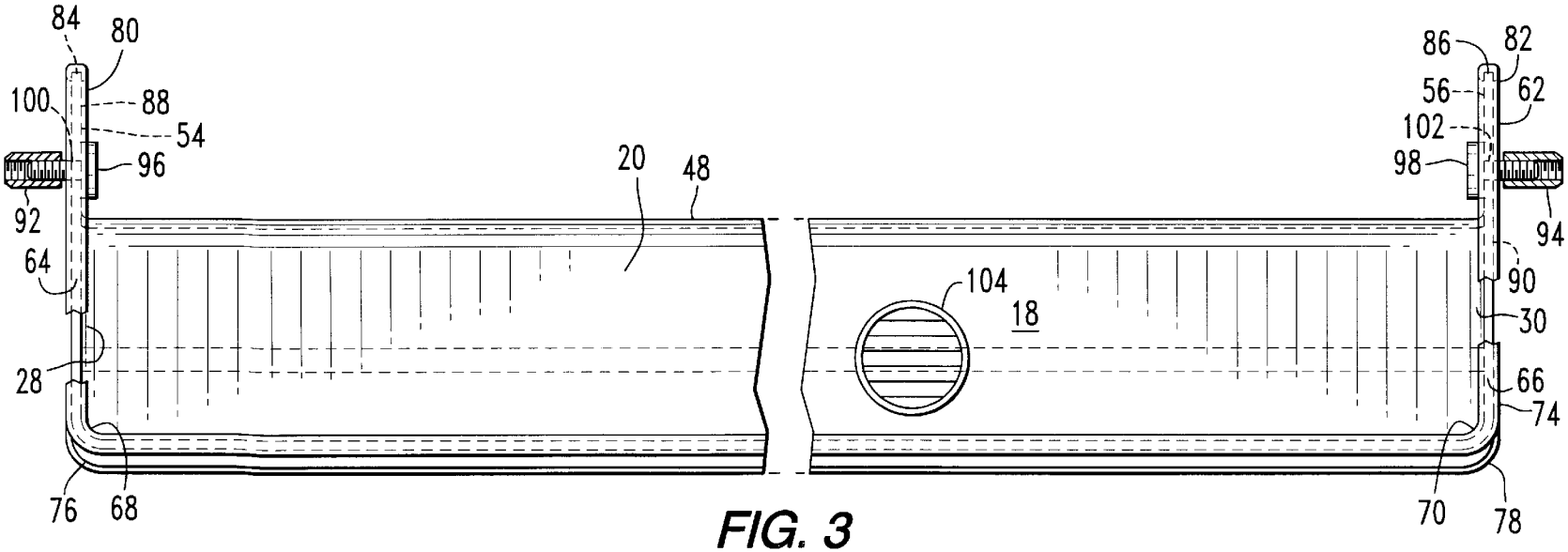
FIG. 3 is a broken elevational view of the removable threshold shown in FIG. 1 showing both ends of the threshold.

As further illustrated in FIG. 1, shower stall 10 can be used either with or without a removable threshold 18. If the individual user so elects, threshold 18 can be easily installed in shower stall 10 as hereinafter more fully explained to provide a threshold that presents an improved barrier to the escape of water through passageway 14.

The preferred embodiment of threshold 18 includes a monolithic body that is herein further described in accordance with its various parts. Threshold 18 can be comprised of molded plastic that is reinforced with fiberglass or equivalent material. Threshold 18 includes a first sidewall 20 and a second sidewall 22. Sidewalls 20 and 22 each have a generally rectangular shape that is defined between first and second elongated boundaries or sides and first and second terminal portions or ends.

More specifically, sidewall 20 is defined by an upper lateral boundary or side 24, lower lateral edge 26, first end or terminal portion 28 and second end or terminal portion 30. Upper lateral boundary 24 is disposed on sidewall 20 oppositely from lower lateral edge 26. Also, first terminal portion 28 is disposed on sidewall 20 oppositely from second terminal portion 30 with each of first and second terminal portions 28 and 30 being vertically located between upper lateral boundary 24 and lower lateral edge 26.

Similarly, sidewall 22 is defined by an upper lateral boundary or side 32, a lower lateral edge 34, first end or terminal portion 36 and second end or terminal portion 38. Upper lateral boundary 32 is disposed on sidewall 22 oppositely from lower lateral edge 34. First terminal portion 36 is disposed on sidewall 22 oppositely from second terminal portion 38 with each of first and second terminal portions 36 and 38 being vertically located between upper lateral boundary 32 and lower lateral edge 34.

Preferably, first sidewall 20 is contoured so that portion of first sidewall 20 that is adjacent to lower lateral edge 26 forms a surface 40 that is oriented substantially orthogonally with respect to the surface portion 42 of first sidewall 20 that is adjacent to upper lateral boundary 24. Similarly, second sidewall 22 is contoured so that portion of second sidewall 22 that is adjacent to lower lateral edge 34 forms a surface 44 that is oriented substantially orthogonally with respect to the surface portion 46 of second sidewall 22 that is adjacent to upper lateral boundary 32.

Threshold 18 further includes a top section 48 that has a generally saddle shape. Top section 48 is defined by two elongated sides 50 and 52 and two terminal portions or ends 54 and 56. First terminal portion 54 is disposed on top section 48 oppositely from second terminal portion 56 with each of said first and second terminal portions 54 and 56 being located laterally between elongated sides or side boundaries 50 and 52 of top section 48.

The first upper lateral boundary 24 of sidewall 20 is joined to elongated side 50 of top section 48. The first upper lateral boundary 32 of sidewall 22 is joined to elongated side 52 of top section 48. Elongated sides 50 and 52 are oppositely disposed on top section 40 such that sidewalls 20 and 22 cooperate to support top section 48. As shown in the preferred embodiment, the junction of boundary 24 and side 50 and the junction of boundary 32 and side 52 form a monolithic joint. As particularly shown in FIG. 2 in cross-section, these joints form arcs 58 and 60 having a substantially constant radius.

Threshold 18 further includes a gasket 62 that is connected to lower lateral edge 26 of sidewall 20 and that is also connected to lower lateral edge 34 of sidewall 22. Gasket 62 is made of tubular rubber or equivalent material and forms a seal between threshold 18 and drainage pan 12 when threshold 18 is installed in shower stall 10. Alternatively, gasket 62 could also be connected to either lower lateral edge 34 alone or lower lateral edge 26 alone.

As hereafter further described, lower lateral edge 26 of side 20 cooperates with the respective edges 64 and 66 of first and second terminal portions 28 and 30 of sidewall 20 to form radiused corner 68 at the junction of lower edge 26 and edge 64 of first terminal portion 28, and to form radiused corner 70 at the junction of lower edge 26 and edge 66 of second terminal portion 30. Similarly, lower lateral edge 34 of side 22 cooperates with the respective edges 72 and 74 of first and second terminal portions 36 and 38 of sidewall 22 to form radiused corner 76 at the junction of lower edge 34 and edge 72 of first terminal portion 36, and to form radiused corner 78 at the junction of lower edge 34 and edge 74 of terminal portion 38.

Gasket 62 is continuously connected to the lower lateral edge 26 and edges 64 and 66 of terminal portions 28 and 30 of sidewall 20 through radius corners 68 and 70. Gasket 62 is also continuously connected to lower lateral edge 34 and edges 72 and 74 of terminal portions 36 and 38 of sidewall 22 through radiused corners 76 and 78. In this way, the disclosed structure also provides that sidewalls 20 and 22 are continuously sealed against the surfaces of shower 10.

Preferably, the surface of each of said first and second terminal portions 54 and 56 of top section 48 is oriented in a substantially orthogonal plane with respect to the surface portion of top section 48 that is located between first and second terminal portions 54 and 56. Also preferably, terminal portions 28 and 30 of sidewall 20 have surfaces that are oriented in a substantially orthogonal plane with respect to the surface portion of sidewall 20 that is located between first and second terminal portions 28 and 30. Similarly, terminal portions 36 and 38 of sidewall 22 have surfaces that are oriented in a substantially orthogonal plane with respect to the surface portion of sidewall 22 that is located between first and second terminal portions 36 and 38. Also preferably, the distal ends 80 and 82 of terminal portions 54 and 56 of top section 48 have continuous edges such as radiused edges 84 and 86 respectively. In this way radiused edge 84 combines with the edges 64 and 72 of terminal portions 28 and 36 and radiused edge 86 combines with the edges 66 and 74 of terminal portions 30 and 38 to provide continuous edges 88 and 90 between sidewall 20 and sidewall 22 at respective ends of threshold 18. Gasket 62 is secured adjacent continuous edges 88 and 90. This structure allows gasket 62 also to be continuous between sidewall 20 and sidewall 22 at respective ends of threshold 18.

Additionally, radiused corner 68 of sidewall 20 combines flush with one end of continuous edge 88 and radiused corner 76 of sidewall 22 combines flush with the opposite end of continuous edge 88. Similarly, radiused corner 70 of sidewall 20 combines flush with one end of continuous edge 90 and radiused corner 78 of sidewall 22 combines flush with the opposite end of continuous edge 90. Gasket 62 is secured adjacent lower lateral edge 26, radiused corner 68, continuous edge 88, radiused corner 76, lower lateral edge 34, radiused corner 78, continuous edge 90, and radiused corner 70. This structure allows gasket 62 to be continuous between lower lateral edge 26 of sidewall 20 and lower lateral edge 34 of sidewall 22 at both ends of threshold 18. This continuous gasket provides an improved watertight seal between threshold 18 and shower stall 10.

Threshold 18 also includes a means for securing the threshold to shower stall 10. In the preferred embodiment, the securing means is a set of threaded anchors 92 and 94 that cooperate with respective knurled screws 96 and 98. Terminal portions 54 and 56 of top section 48 are respectively provided with holes 100 and 102.

To secure threshold 18, it is positioned in passageway 14 with gasket 62 forming a seal between threshold 18 and drainage pan 12 and with terminal portions 54 and 56 of top section 48 opposing portions of shower stall 10 defining passageway 14. Anchors 92 and 94, which are embedded in stall 10, are located in shower stall 10 such that with threshold 18 in position, holes 100 and 102 are in alignment with anchors 92 and 94. Knurled screws 96 and 98 are then inserted through holes 100 and 102 and threaded into respective anchors 92 and 94. In this way, terminal portions 54 and 56 are located between screws 96 and 98 and fixture 10 such that screws 96 and 98 urge terminal portions 54 and 56 against fixture 10.

Alternatively, terminal portions 28 and 30 of sidewall 20 or terminal portions 36 and 38 of sidewall 22 could also be provided with holes and the anchor assembly located in alignment therewith such that the securing means would secure first sidewall 20 or second sidewall 22 to the fixture. Specifically, the fastener engages the anchors with at least one terminal portion of top section 48, sidewall 20 or sidewall 22 located between screws 96 and 98 and stall 10 such that fasteners urge at least one terminal portion against stall 10.

Preferably, sidewall 20 is provided with at least one vent 104 to promote the exchange of air under top section 48 and to better preserve the portion of fixture 10 that is covered by threshold 18. Also, threshold 18 is provided with a cross-member 106 that is secured to the interior surfaces of sidewalls 20 and 22 to further strengthen and stabilize threshold 18.

While a presently preferred embodiment of the invention is shown and described herein, it will be apparent to those skilled in the art that the invention can be otherwise variously embodied within the scope of the following claims.

I claim:

1. A removable threshold for use in fixtures, said threshold comprising:

a top section that has a generally rectangular shape that is included between two elongated sides that are oppositely disposed with respect to each other, said top section including first and second ends that are located between the two elongated sides and oppositely disposed with respect to each other;

first and second sidewalls, said first and second sidewalls each having a generally rectangular shape that is included between first and second elongated sides and between first and second ends, the first elongated side of each of said sidewalls being joined to a respective elongated side of said top section and the second elongated side of each of said first and second sidewalls being oppositely disposed from the first elongated side that is joined to said top section, the second elongated side cooperating with the first and second ends of said sidewalls to form a concavely radiused corner at each end; and a gasket that is connected to the second elongated side of the first and second sidewalls and to the first and second ends of each of the first and second sidewalls, said gasket also being secured to the ends of the top section, said gasket being continuous over the second sides of each of the first and second sidewalls, the first and second ends of each of the first and second sidewalls and the first and second ends of the top section.

2. The removable threshold of claim 1 further comprising:

means for securing the threshold to the fixture.

3. The removable threshold of claim 2 wherein said securing means comprises a fastener and anchor assembly wherein the anchor portion is adapted to be secured to the fixture, and wherein the fastener portion is threadably connected to the anchor portion and urges the threshold against the fixture.

4. The removable threshold of claim 1 wherein the top section is connected to the first and second sidewalls by a radiused joint.

5. The removable threshold of claim 1 wherein portions of the first sidewall adjacent to the second elongated side are substantially orthogonal to portions of the first sidewall that are adjacent to the first elongated side and wherein portions of the second sidewall adjacent to the second elongated side are substantially orthogonal to portions of the second sidewall that are adjacent to the first elongated side.

6. A removable threshold for use in fixtures, said threshold comprising:

a rectangular-shaped top section having two side boundaries that are oppositely disposed with respect to each other, said top section also having two ends that are also oppositely disposed with respect to each other;

first and second sidewalls having an upper lateral boundary and a lower lateral edge, said upper lateral boundaries of said first and second sidewalls being oppositely disposed from the respective lower lateral edges of said first and second sidewalls, said upper lateral boundary of each sidewall being joined with a respective side boundary of said rectangular-shaped top section such that said first and second sidewalls support said top section, said first sidewall including first and second terminal portions that are oppositely disposed from each other, each terminal portion being located between the upper lateral boundary and the lower lateral edge of the first sidewall, said second sidewall including first and second terminal portions that are oppositely disposed from each other, each terminal portion being located between the upper lateral boundary and the lower lateral edge of the second sidewall, the lower lateral edge of each of the first and second sidewalls cooperating with the first and second terminal portions of their respective sidewall to form concavely radiused corners; and a gasket that is continuously connected to the lower lateral edge and to the respective terminal portions of said first and second sidewalls through the radiused corners to provide a continuous seal between the sidewalls and the fixture.

7. The removable threshold of claim 6 wherein said first and second sidewalls are connected by at least one cross-member.

8. The removable threshold of claim 6 further comprising means for securing the threshold to the fixture, said securing means including a fastener and anchor assembly in which the anchor is adapted to be secured to the fixture and in which the fastener engages the anchor and impinges on at least one of the ends of the rectangular-shaped top section, a terminal portion of the first sidewall and a terminal portion of the second sidewall to urge it against said fixture.

9. The removable threshold of claim 8 wherein the exposed surface of the anchor is substantially flush with the surface of the fixture.

10. A removable threshold for use in fixtures, said threshold comprising:

a rectangular-shaped top section having two side boundaries that are oppositely disposed with respect to each other, said top section also having two ends that are oppositely disposed with respect to each other, said top section including first and second terminal portions that are oppositely disposed from each other, each terminal portion being located between the side boundaries of the top section and defining a continuous edge, each of said terminal portions being oriented generally orthogonally with respect to the portion of the top section between the first and second terminal portions;

first and second sidewalls having an upper lateral boundary and a lower lateral edge, said upper lateral boundary of each sidewall being joined with a respective side boundary of said rectangular-shaped top section such that said first and second sidewalls support said top section, said upper lateral boundaries of said first and second sidewalls being oppositely disposed from the respective lower lateral edges of said first and second sidewalls, said first sidewall including first and second terminal portions that are oppositely disposed from each other, each terminal portion of said first sidewall being located between the upper lateral boundary and the lower lateral edge of the first sidewall and defining an edge that combines with the continuous edge of a terminal portion of said top section, said second sidewall including first and second terminal portions that are oppositely disposed from each other, each terminal portion of said second sidewall being located between the upper lateral boundary and the lower lateral edge of the second sidewall and defining an edge that combines with the continuous edge of a terminal portion of said top section, the lower lateral edge of each of the first and second sidewalls cooperating with the first and second terminal portions of their respective sidewall to form concavely radiused corners; and a gasket that is continuously connected to the lower lateral edge and to the respective terminal portions of said first and second sidewalls through the radiused corners and to the continuous edges of the terminal portions of said top section to provide a continuous seal between the sidewalls and the fixture and between the top section and the fixture.

11. The threshold of claim 10 wherein each side boundary of said top section is joined with a respective upper lateral boundary of said first and second sidewalls in a monolithic joint.

12. The threshold of claim 10 wherein each terminal portion of said first sidewall is oriented substantially orthogonally with respect to the portion of the first sidewall that is located between the first and second terminal portions, and wherein each terminal portion of the second sidewall is oriented substantially orthogonally with respect to the portion of the second sidewall that is located between the first and second terminal portions.

13. The threshold of claim 12 further comprising means for securing at least one of a terminal portion of said top section, a terminal portion of said first sidewall and a terminal portion of said second sidewall to the fixture.

14. The threshold of claim 13 wherein said means for securing comprises a fastener and anchor assembly wherein an anchor of the assembly is adapted to be secured to the fixture and a fastener of the assembly engages the anchor portion with at least one of said terminal portion of said top section, said terminal portion of said first sidewall and said terminal portion of said second sidewall being located between the fastener and the fixture such that the fastener urges at least one terminal portion of said top section, said first sidewall and said second sidewall against the fixture.

15. The threshold of claim 14 wherein at least one of the terminal portions of the top section of said threshold has a hole therethrough and the fastener portion is a threaded member that extends through the hole and engages the anchor.

16. The threshold of claim 10 further comprising a vent that is provided in at least one of said first and second sidewalls.

* * * * *